United States Patent [19]
Roberts et al.
[11] 4,242,377
[45] Dec. 30, 1980

[54] FABRIC CONDITIONING

[75] Inventors: Karl H. Roberts, Flemington; Marvin Liebowitz, Edison; Henry P. Furgal, Bernardsville, all of N.J.

[73] Assignee: Colgate-Palmolive Company, New York, N.Y.

[21] Appl. No.: 441,303

[22] Filed: Feb. 11, 1974

Related U.S. Application Data

[63] Continuation of Ser. No. 109,691, Jan. 25, 1971, abandoned.

[51] Int. Cl.[2] ..... B05D 3/12

[52] U.S. Cl. ..... 427/242; 8/149.1; 252/8.6; 252/8.8; 252/90; 252/92; 252/305; 427/373; 427/401; 428/291

[58] Field of Search ..... 8/149.1; 252/8.6, 8.8, 252/90, 92, 305; 427/242, 401, 373; 428/291

[56] References Cited

U.S. PATENT DOCUMENTS

| | | | |
|---|---|---|---|
| 2,023,013 | 12/1935 | Faber et al. | 8/149.1 X |
| 2,205,042 | 6/1940 | Lenher et al. | 427/242 X |
| 2,655,480 | 10/1953 | Spitzer et al. | 252/90 |
| 3,256,180 | 6/1966 | Weiss | 252/8.8 |
| 3,442,692 | 5/1969 | Gaiser | 427/242 X |
| 3,632,396 | 1/1972 | Perez-Zamora | 427/242 X |

*Primary Examiner*—Michael R. Lusignan

[57] ABSTRACT

Fabrics, such as those in laundry items, are softened and their tendency to accumulate static charges is lessened by application to them of a foam which includes a foaming agent, a fabric conditioner, to improve fabric softness and/or to diminish static, a normally gaseous propellant and water, after which application the laundry is tumbled, preferably in a dryer. The foam thereby becomes spread over the fabric surfaces, conditioning the laundry during a drying operation. In some products a single material may be both foaming agent and conditioner. In other formulations a foam stabilizer will be incorporated to aid the foaming agent in making a more useful foam.

In preferred embodiments of the invention, the conditioning composition is a liquid held under its own pressure in a dispensing container and is discharged from it as a stable foam onto the material to be conditioned, which is in a laundry dryer. In preferred compositions the foaming agent is an anionic or nonionic surface active compound, the fabric conditioner is an amphoteric or cationic surface active agent which is substantive to cotton and permanent press fabrics to be conditioned, and the propellant is a mixture of halogenated hydrocarbons.

The disclosure also relates to pressurized compositions, articles comprising pressure-tight vessels containing such compositions, and the foams dispensed, as well as to methods of application of the foams to fabrics and laundry to be conditioned.

28 Claims, No Drawings

FABRIC CONDITIONING

This is a continuation of application Ser. No. 109,691 filed Jan. 25, 1971, abandoned.

SUBJECT OF THE INVENTION

This invention relates to the conditioning of fabrics, such as those made of cotton or synthetic fibers or mixtures thereof, which may have been treated so as to be permanently pressed. The conditioning improves the softness of the fabrics and diminishes their tendencies to accumulate static charges. The conditioning operation is effected with a softening or antistatic agent in a foam, which is preferably applied to the fabrics of laundry being dried in an automatic laundry dryer.

BACKGROUND OF THE INVENTION

Fabrics, yarns, threads, manufactured textile articles, such as clothing, and laundry have all been treated at some stage in the manufacturing process or subsequently, to impart desirable properties to them. Compositions for effecting such treatments have been produced in various physical forms, including emulsions and sprays, and applications have been made at different temperatures and under various conditions so as to effect optimum treatments. Among the treatments have been the applications of softening and antistatic agents to fabrics.

The treatment of laundry in the washing machine to improve the softness of the fabrics thereof is well known. Usually, specific substantive treating compounds have been incorporated in detergent compositions or have been dissolved in the wash water or rinse water. Effective conditioning compounds employed have been cationic softening agents, often of the quaternary ammonium salt type. Most effective commercial applications of such softeners have been in the rinse water utilized in a laundering operation. Some softening operations have been undertaken in the laundry dryer. Softening agents have been sprayed onto the laudry or the dryer interior. Both nebulizing devices included in the dryer and aerosol sprays have been employed to direct onto laundry germicides, starches and other materials for improving the properties of the treated laundry. Fabric conditioning agents have been incorporated in cellulosic substances and from these have been transferred to laundry being dried in an automatic laundry dryer.

The methods described above, although useful in many cases, possess certain drawbacks which make the discovery and development of improved conditioning techniques desirable. For example, cationic conditioning agents are not effectively applied to fabrics from aqueous solutions of anionic washing agents. Non-substantive conditioning agents are useless or essentially ineffective in rinse water applications because most of the active softening material is removed with the water expressed from the fabric. Utilization of waxy cationic conditioning agents on paper has given rise to over-application of the waxy substance on the laundry and in many cases such a waxy deposit appears as an oily spot or stain, especially after ironing. Although this spotting problem has been effectively overcome in applications in which the composition of the treating agent is modified so that excessive applications are avoided, there is room for improvement in the forms of conditioning products and processes, especially in making them easier to use and less sensitive to variation of dryer conditions. For example, pressurized compositions of the "aerosol" type are easily stored, ready for use, and are very convenient to employ. The housewife is familiar with the use of "aerosol" products, has accepted them. Accordingly, the present inventors have worked to produce useful fabric conditioners from aerosols.

Although one can prepare aerosol sprays, which are described in an application for patent entitled SOFTENING OF FABRICS, filed by one of the present inventors (H. P. Furgal) on the same day as the present application, for ease of measuring the quantity of product applied without the need for expensive metering valve parts, to avoid the need for spraying droplets of conditioning agent into the dryer, and to improve conditioning resulting, it has been considered desirable to provide a different physical form of the conditioning agent. Although the use of a foam or lather of conditioning composition might be expected to be ineffective, because it would be thought that foam would deposit too much conditioning material on particular sites of the fabrics being treated and would not facilitate spreading of the conditioner over all the laundry, the contrary has been discovered, especially when stable foams are used. Such products are readily applied, easily transferred over the fabrics of all the laundry while the laundry is being tumbled in the dryer and do not cause staining, even when cationic conditioning agents are employed and are applied to permanent press items which are subsequently ironed.

DESCRIPTION OF THE INVENTION

In accordance with the present invention a method of conditioning fabrics comprises applying to a fabric a composition comprising a foaming agent, a fabric conditioner, a normally gaseous propellant and water, as a foam, and spreading the foam over the surfaces of the fabric by subjecting the fabric to a tumbling action.

In a preferred embodiment of the method, the foaming agent is an anionic or nonionic surface active compound, such as triethanolamine stearate, or polyoxyethylene lauryl ether stabilized with cetyl alcohol, the fabric conditioner is an amphoteric or a cationic softening agent, such as complex fatty amido compound or a quaternary ammonium halide, the propellant is an organic liquefied gas, such as a mixture of chloro-fluorocarbons and the treatment is of laundry of cotton and permanent press synthetic fiber fabrics in an automatic laundry dryer. The composition employed is a pressurized emulsion containing described proportions of the mentioned constituents. The conditioning article, including a pressure-retaining, valved container, the conditioning composition and the foam produced are also within the invention.

DETAILED DESCRIPTION OF THE INVENTION

The conditioning agents or compounds employed are substances which, when applied to fabrics, which fabrics may be of natural or synthetic materials, improve the tactile properties of the fabric, usually making it softer to the touch. They also may have the advantage of making fabric less apt to accumulate static charges, thereby decreasing the tendency of synthetic fabrics, especially, to transmit annoying static shocks. When clothing or other articles made from textiles is subjected to a drying operation wherein the articles are moved, as in an automatic laundry dryer, it is softened somewhat by the mechanical flexing that occurs but annoying static charges are picked up, especially by synthetic fiber articles, often causing them to wrinkle, crackle or transmit shocks to the person removing them from the dryer. Where built synthetic organic detergent compositions are used, instead of soap, due to their better washing properties and a tendency to leave less lipophilic material on the clothing, despite the flexings of the drying operation the laundry which is dried often becomes hard or stiff, at least in some sections thereof. It has been found that if such laundry has applied to the surfaces thereof or is treated with small quantities of fabric softening chemicals, the fabrics are made softer and less prone to acquire annoying static charges. As to softening effects, most significant results are noted on cotton articles whereas with respect to decreasing electrostatic charges, the treatments are most advantageous when applied to synthetic fibers, such as nylon, Dacron® or polyester-cotton blends, e.g., 65–35 blends, which may have been treated to make them crease-resistant or permanent press.

Although various surface active materials have been found to improve either softening or antistatic properties of fabrics, best results are usually obtained with cationic or amphoteric fabric conditioners. The cationics are excellent softeners and antistatic agents but some of them also tend to produce greasy or oily spots on materials to which they are applied in excessive concentrations or amounts. Such spots are most apparent when the laundry is colored and made of a synthetic fiber, such as a cotton-polyester blend, and the staining is especially apparent if the fabric is treated to make it crease-resistant or of permanent press characteristics. Therefore, applications of such materials which obviate the concomitant production of oily spots are highly desirable.

The quaternary ammonium compounds constitute a known class of fabric softeners and are described at length in the literature as being useful for such purpose. These compounds are mentioned in U.S. Pat. No. 3,442,692 and therefore, a lengthy compilation herein is not considered to be required. In addition to quaternary ammonium salts, corresponding quaternary phosphonium salts can also be useful. The quanternary compounds will usually contain a plurality of lower alkyl groups on the quaternary atom, e.g., nitrogen, and one or two higher alkyls, benzyls or equivalent groups thereon. The salt-forming ion will preferably be a halide, such as chloride or bromide, but may also be any such useful solubilizing group. A preferred quaternary compound that is employed is distearyl dimethyl ammonium chloride but other quaternaries of similar activity may also be used, including cetyl trimethyl ammonium bromide, dimethyl dilauryl ammonium chloride, diethyl distearyl ammonium chloride, dimethyl di-(hydrogenated tallow alkyl) ammonium chloride, stearyl dimethyl benzyl ammonium chloride and lauryl methyl dibenzyl ammonium bromide. Also useful are various other cationics, such as alkyl pyridine salts, alkyl imidazolines, higher alkyl amines, of the primary, secondary or tertiary types and higher alkyl guanidine salts, e.g., 1-methyl-1-stearyl aminoethyl-2-stearyl imidazolinum methosulfate, stearyl pyridinium halides, cetyl isoquinolinium bromide and alkyl morpholinium chlorides. In the aforementioned cases, lower alkyl is of 1 to 5 carbon atoms, preferably 1 or 2, and higher alkyl is of about 8 to 20 carbon atoms, preferably 12 to 18. Although mixtures of the cationic softeners or antistatic agents with nonionic or amphoteric softeners may be used, generally such mixtures with anionics will be avoided, due to objectionable chemical interactions.

The amphoteric conditioners that have been found to be most useful at the present time are the complex fatty amido compounds such as the Soromines®, e.g., Soromine AT and Soromine AL, sold by GAF Corp. Various other amphoteric compounds, usually possessing primarily cationic properties under final use conditions, include the higher alkyl beta-alanines, the N-higher alkyl taurines, e.g., reaction product of lauryl amine with sodium isethionate, the N-higher alkyl aspartic acids and the Miranols®, described in U.S. Pat. No. 2,528,378. Related compounds which are useful include the Zwitterionic surface active agents such as betaine and similar detergents which form inner salts.

Of the nonionic surface active materials which are useful as fabric conditioners, some preferred embodiments include the polyoxy-lower alkylene higher alkyl ethers, e.g., polyoxyethylene lauryl ether having four epoxy groups (Brij 30); higher alkylphenoxy poly(-lower alkoxy) lower alkanols, e.g., nonyl phenoxy polyethoxy ethanol (Igepal CO 880); and balanced hydrophilic-lipophilic compounds made by the condensation of lower alkylene oxides with an organic hydrophobic material, e.g., Pluronics®. The nonionic softeners usually include lipophilic groups having higher alkyl components, generally of 8 to 20 carbon atoms and hydrophilic components which are poly-lower alkylene oxides often having 4 to 20 moles of lower alkylene oxide per mole. The lower alkylene oxides are of 2 to 3 carbon atoms, preferably being ethylene oxide. Such materials, other nonionic softeners and anionic softeners are described in the patent application entitled FABRIC CONDITIONING METHODS, ARTICLES AND COMPOSITIONS, filed by G. T. Hewitt and A. S. Wilson in the U.S. Patent Office in 1970.

Other useful nonionic softeners include the amine oxides and the alkanolamides. The former are usually higher alkyl di-lower alkyl amine oxides wherein the higher alkyl is of 8 to 20 carbon atoms and the lower alkyl is of 1 to 4 carbon atoms, preferably being methyl. The alkanolamides may be mono-, di- and tri-lower alkanolamides of higher fatty acids, e.g., myristic diethanolamide, palmitic monoethanolamide.

The anionic surface active materials which are useful as fabric conditioners (that term means that the conditioning agent softens and/or diminishes static charge accumulation on the fabric) include water soluble salts such as the soluble salts of organic sulfuric reaction products which have an alkyl radical of from about 8 or 10 to about 18 or 20 carbon atoms and either a sulfonic acid or sulfuric acid ester radical. The corresponding compounds containing acyl groups of similar chain length are also included. Representative of these materials are the higher alkyl sulfates of from 18 to 20 carbon atoms, the higher alkyl benzene sulfonates, preferably the linear alkyl benzene sulfonates wherein the alkyl group is of 10 to 18 carbon atoms, preferably from 12 to 15 carbon atoms, the higher fatty acyl taurides and isethionates, higher fatty acid monoglyceride sulfates and sulfonates, higher fatty glycerol ether sulfonates, the sulfuric acid esters of reaction products of 1 mole of higher fatty alcohol with from 1 to 6 moles of lower alkylene oxide and alkyl phenyl lower alkylene oxide ether sulfates containing from 1 to 10 moles of lower alkylene oxide per molecule. Specific examples of such materials include sodium tallow alcohol sulfate, sodium hydrogenated tallow alcohol sulfate, sodium lauryl sulfate, triethanolamine n-hexadecyl sulfate, trimethylamine cetyl sulfate, potassium n-octadecyl sulfonate, sodium coconut oil fatty acid monoglyceride sulfate, sodium n-dodecyl benzene sulfonate, sodium tetradecyl toluyl sulfonate, nonyl phenyl polyoxyethylene sulfate wherein the polyoxyethylene group is of 5 moles of ethylene oxide, sodium dodecyl glycerol ether sulfonate and potassium oleyl N-methyl tauride. Such compounds may be employed alone or in mixture.

In addition to the synthetic anionic organic detergents, the water soluble higher fatty acid soaps may also be employed. These are usually the alkali metal salts of higher fatty acids of 8 to 20 carbon atoms, preferably 12 to 18 carbon atoms and are normally derived from natural sources, such as coconut oil, palm oil, corn oil, tallow and mixtures thereof. However, trialkanolamine and trialkylamine salts such as triethanolamine soaps may be used, as may be other known soluble soaps suitable for the present purposes. Exemplary of such materials are the sodium soap of an 85:15 mixture of tallow and coconut oil fatty acids, the potassium soap of stearic acid, the mixed sodium and potassium soaps of a 50:50 mixture of tallow and coconut oil fatty acids, sodium "cocate", potassium stearate, triethanolamine stearate and sodium laurate.

In addition to the water soluble salts, the water insoluble salts of calcium, magnesium, lithium, and other "heavy" metals which form water insoluble soaps may be employed. However, it may generally be preferred to utilize the corresponding water soluble products which are less difficult to incorporate in "aerosol" compositions.

Of the anionic materials it is most preferred to utilize those which are higher alkyl sulfates or water soluble soaps of higher fatty acids. For example, hydrogenated tallow alcohol sulfates, usually as the sodium salt, and sodium cocotallow soaps comprising 85% tallow and 15% coconut oil soap, optionally with a portion of the sodium, e.g., from 10 to 40%, replaced by potassium, are preferred.

Various other softening and anti-electrostatic charge conditioning agents are found listed in *DETERGENTS AND EMULSIFIERS,* 1969 Annual Edition, by John W. McCutcheon who classifies the various surface active agents as anionic, cationic, nonionic and amphoteric and lists those having especially good conditioning properties. In the description herein and in the cited listings, the higher alkyls will usually be of 8 to 20 carbon atoms and the lower alkyls will be of 1 to 4 carbon atoms, with the preferred compounds often having higher alkyls of 12 to 18 carbon atoms and lower alkyls of 1 or 2 carbon atoms.

The foaming agents employed in the present compositions and processes may be any of a wide variety of suitable compounds, which, in the presence of the conditioning agent, water, propellant and any other components of the composition, will produce a suitable foam for application to the fabrics to be conditioned. The foam made will be such that on discharge from a conventional aerosol container, preferably equipped with a foam producing valve and spout, it will be a lather which is firm enough to be self-sustaining for a period of at least about five minutes. Such a lather will not be broken up into small particles, like a spray, but on the contrary, will form a body of "aerated" conditioning composition if sprayed onto a stationary surface. The lather or foam made will preferably be quite different from that of a pressurized shaving cream. It will be firmer and substantially form retaining unless subjected to shocks or rubbing actions. Yet, in some applications, weaker foams may be employed, although they are not as stable as desired, providing that they are sufficiently coherent to be applied to the laundry in a cohesive form.

The foaming agents utilized to produce such foams may be any of a wide variety of surface active products, including soaps and synthetic detergents. While amphoteric and cationic surface active agents may be used for this purpose, generally foam produced by these materials will be too lacy to form sufficiently coherent foams and therefore, it is preferable to employ anionic surface active agents or nonionic materials of this type. Of these classes of foaming agents, the anionics are better, as a rule, but the nonionics may be used and a satisfactory foam may be produced if a foam stabilizer is incorporated in the composition. Of course, such stabilizers may be used with other surface active agents to improve their foaming powers, too.

As a rule, to produce the best products, one utilizes a conditioning agent for softening and/or antistatic effects and a different foaming agent to produce a desired physical form of the product. However, this is not necessary and it is within the invention to utilize one material for both functions. For example, triethanolamine stearate possesses both foaming and conditioning properties and a composition in which it is present with water and propellant possesses conditioning properties and is in satisfactory foam form. Of course, if a single compound is to function as both conditioner and foaming agent, the amount utilized will usually be the sum of the amounts of separate components that would otherwise be employed.

The anionic foaming agents include the various anionic surface active materials previously described, which also function as conditioners. A listing of such synthetic compounds is found in the McCutcheon publication previously cited and these are characterized therein as foaming agents, emulsifiers or detergents. Similar listings may be found in the text *SYNTHETIC DETERGENTS* by Schwartz, Perry and Berch, published in 1958 by Interscience Publishers. Although it is not usually necessary, if the anionic foams produced are not sufficiently stable, their quality may be improved by incorporation of stabilizing additives, including higher fatty alcohols and natural and synthetic gums, which stabilizers will be discussed below.

Of the anionic detergents and foaming agents those which form highly acceptable foams include the higher fatty acid soaps, preferably water soluble but also including the water insoluble soaps, and the sulfuric reaction product foaming agents. The soaps are of higher fatty acids, usually of 8 to 20 carbon atoms and preferably of 12 to 18 carbon atoms and are generally present as mixtures, as they are obtained from natural oils and fats. Although the alkali metal, alkaline earth metal, amine, lithium, heavy metal and alkanolamine soaps may be employed, it is generally preferred to utilize the alkali metal soaps or the alkanolamine soaps. The alkanolamine may be mono-, di- and trialkanolamine and usually will be of 2 to 4 carbon atoms, preferably of two carbon atoms and most preferably, is triethanolamine. When utilizing triethanolamine the preferred fatty acids employed will be triple pressed stearic acid, a mixture of palmitic and stearic acids. Instead of the triethanolamine stearate or other alkanolamine stearates, the various other described soaps may be employed or may be used in mixture with the alkanolamine soaps, if desired. By varying the soap mixture or a mixture of soap with other anionic or nonionic foaming agent, the properties of the final foam may be regulated. In place of the triethanolamine stearate other alkanolamine soaps and alkali metal soaps, preferably sodium or mixed sodium-potassium soaps of higher fatty acids, such as those obtained from a 20% coconut oil-80% tallow charge, may be employed.

The organic sulfuric reaction product detergents comprise a well known class wherein the hydrophobic proportion of the foaming agent molecule is an alkyl, aryl, arylalkyl or alkylarlyl moiety and the hydrophilic portion is sulfonate or sulfate. In such compounds, the aryl is generally phenyl and the alkyl is normally a higher alkyl, of 8 to 20 carbon atoms, although in some foaming agents the alkyl of the alkylaryl is lower alkyl or poly-lower alkyl, of 1 to 4 carbon atoms. Examples of preferred foaming agents of this type include sodium tallow alcohol sulfate, triethanolamine tallow alcohol sulfate, sodium monoglyceride sulfate, potassium dioctyl sulfosuccinate, sodium lauryl sulfonate, sodium tetradecyl benzene sulfonate and equivalent water soluble salts of other of the mentioned cations.

While the mentioned water soluble soaps and synthetic surface active agents are preferred foaming materials, they may be replaced in part and sometimes entirely by water insoluble soaps, such as the alkaline earth metal, lithium, and heavier metal soaps which often can exert a desired thickening effect in such compositions. Yet, the amounts of insoluble soaps used to aid in foaming will normally be kept smaller than of other foaming agents because they tend to remain on treated fabrics and sometimes this "permanence" can be objectionable.

To produce the desired foams a liquefiable normally gaseous propellant is employed. Various such compounds are well known in the aerosol art and an extensive listing thereof is not required here. Generally they will be lower aliphatic or cycloaliphatic chloro-fluorocarbons or the corresponding fluorocarbons or hydrocarbons. These materials are sold as propane, isobutane, cyclobutane, Freons®, Genetrons®, Ucons®, and by other trade names and are identified as Propellants 11, 12, 113, 114, 21, 22, etc. Of these propellants it is preferred to utilize those which are fluorocarbons or chloro-fluorocarbons (such may contain free hydrogen atoms) and are essentially hydrolysis-resistant. Such compounds are generally innocuous and are non-flammable. Normally, the propellants will be employed in mixtures, a high pressure propellant being blended with a low pressure propellant to produce the desired final pressure in the container from which the foam is to be dispensed. Such a pressure will generally be from 10 to 100 lbs. per square inch and the mixtures of propellants will usually include one having a pressure lower than 20 lbs./sq. in. at room temperature and another having a pressure above 20 lbs./sq. in. and usually above 40 lbs./sq. in. at such temperature. Minor proportions of hydrocarbon propellants may be utilized in compositions intended for discharge into a laundry dryer, providing that the foam dispensed or the gas released is not flammable. Where there is no fire hazard the hydrocarbon propellants may be employed as the sole propellants. In some instances, in addition to the propellants, it may be desired to utilize a solvent which will be lipophilic and therefore miscible with the lipophilic, organic propellants. For example, chlorinated hydrocarbons such as methylene chloride can be used, usually to a minor extent. Care will generally be taken to avoid using flammable solvents where the end use of the composition may be near a heating element or open flame, as in a laundry dryer. A preferred blend of propellants to develop the desired pressure within the 20 to 70 lbs./sq. in. range is a blend of Propellants 12 and 114 (dichlorodifluoromethane and dichlorotetrafluoroethane). Although not as preferred, other pressurizing gases and liquids may be employed, even if not of the organic types described above. Thus, to some extent, nitrogen, carbon dioxide, nitrous oxide and similar propellants may be used to aid in dispensing the product and to modify foaming characteristics.

The water used will normally be deionized water, having a hardness content below 20 parts per million, as calcium carbonate, and preferably below five p.p.m. However, ordinary tap water may be employed and while low hardness, e.g., under 50 p.p.m. is preferred, harder waters, up to 150 p.p.m. and even higher, can be utilized.

In addition to the major constituents of the present compositions, described above, which are used to produce the desired foam and to impart conditioning to the materials to be treated, various adjuvants may be employed to impart additional useful properties to the product. Thus, perfumes, bactericides, fungicides, fluorescent brightening agents, e.g., of the aminostilbene type, may be present, usually in minor proportion, e.g., up to 1% and generally totaling no more than 5% of the final compositions. Of these, those considered to be especially useful adjuvants are the fluorescent brighteners, which have a noticeable effect on the treated laundry, even when employed in very small concentrations.

In addition to the minor adjuvants mentioned above, various other materials may be included to improve the foam and discharge properties of these compositions. The natural and synthetic gums and resins may be used to thicken the emulsion being dispensed from a container, thereby slowing the rate of discharge of the composition, making it more controllable, stabilizing the discharged liquid upon initial contact with a region of reduced pressure and stabilizing foam after discharge. The resins that may be employed include polyvinylpyrrolidone, polyvinyl alcohol, polyacrylamide and various other known synthetic resins, as well as the organic gums, including guar gum, carrageenan, sodium alginate, caseinates and cellulose derivatives, e.g., sodium carboxymethyl cellulose and hydroxy propyl methyl cellulose. In those cases where gelation of the composition is noted in the can or wherein thinning of it is desirable, hydrophilic solvents such as polyhydric alcohols may be employed. These include propylene glycol, glycerol, and other di- and polyhydric alcohols. In some cases, a polyethylene glycol such as Carbowax® 400 may be used. In addition to aiding in the prevention of gel formation, thereby producing a more uniform foam, such materials also often aid in improving the foam quality and stability.

Another important adjuvant, especially useful in improving the foam of nonionic foaming agents, which may also be used with anionic, cationic or amphoteric components, is a foam stabilizer. Such a compound, while it may be of various chemical structures, will often be a higher alcohol. Especially preferred are the higher aliphatic monohydric alcohols, such as the straight chain saturated alcohols of 12 to 18 carbon atoms, e.g., cetyl alcohol. These stabilizers may sometimes be considered to be part of the foaming agent itself, since they are often added to make the foaming agent suitable for the production of a stable foam and coact with the foaming agents, especially the nonionic compounds, to make a stable foam possible. Otherwise, if they are not used, the product discharged may well be watery and may be in spray form. In addition to cetyl alcohol, other equivalent alcohols, such as stearyl alcohol, myristyl alcohol and mixtures of such alcohols may be employed.

The proportions of the various constituents of the foaming conditioning composition and the final product will normally be regulated to be within certain ranges so as to obtain the best results. Although ratios outside the described ranges may be employed and in certain cases may be very satisfactory, generally, for the compositions of the types described herein the formulating chemist will maintain the proportions within the described ranges for best results. Controlling considerations are usually whether the product is discharged as a satisfactory foam and whether the composition satisfactorily conditions the fabrics treated.

The foaming agent, usually exclusive of foam stabilizer, will normally be from 0.5 to 15% of the conditioning composition. Preferably, for example, when triethanolamine stearate is being employed, it will comprise from 2 or 3 to 10% thereof. The fabric conditioner will also usually be from 0.5 to 15% of the product. Preferably, as when the complex fatty amido amphoteric surface active fabric conditioner known as Soromine AT is employed it will be from 1 to 10% of the product. When the same material is both foaming agent and fabric conditioner, the proportions which are useful are from 1 to 30% of the product. The propellant mixture, which usually is a mixture of a major proportion of high pressure propellant and a minor proportion of a low pressure propellant or diluent is from 10 to 79% of the product, preferably 40 to 79% thereof and more preferably 40 to 60%. In many cases it constitutes exactly 50% of the final product and at such concentrations, especially those within the 40 to 60% range, results in the production of a very stable foam, which often will retain its shape for several hours rather than the usually desirable minimum time of five minutes. Some of the described compositions, containing lesser proportions of propellant will not be as stable as desirable but may still be useful within the invention.

The water content, when no other constituents are present, comprises the balance of the composition. Usually this will be from 20 to 50% thereof and it may be from 25 to 45%.

The proportion of foam stabilizer employed with nonionic foaming agent will usually be from 0.2 to 10%, preferably from 0.5 to 5%. Similar proportions may be used with cationic, amphoteric and anionic foaming agents although the foam stabilizer, e.g., cetyl alcohol, is usually not needed with anionics, especially if they are soaps such as alkanolamine soaps. For thickening the compositions and regulating their discharge properties and foam strength and stability, the thickeners or resins may be used to the extent of about 0.2 to 5%, and often this range will be from 0.3 to 2%, as in the case of polyvinylpyrrolidone. When, on the other hand, the composition is too thick or gels on storage, making it difficult to dispense a satisfactory foam, a diluent or a thinning agent of the polyethylene glycol, glycerol, Carbowax or equivalent type may be present, generally to the extent of from 1 to 10% of the product.

For example, when the content of triethanolamine stearate exceeds about 10% of the aqueous phase portion of the composition, gelation therein might occur and in such situations addition of about 5% of glycerine or polyethylene glycol will be advisable to make the product more uniform.

The present compositions are very easily prepared and require no special preparative techniques. It is enough to blend all the ingredients except the propellants, mix them at room temperature and warm them sufficiently to produce a homogeneous product. The various soaps may be made in situ. For example, triethanolamine stearate may be made by blending triethanolamine and stearic acid together initially or later in the mixing together of the composition. Normally, it will not be required to heat the mix to a temperature higher than 50° C. Of course, with fugitive materials, such a perfumes, addition will be at the most appropriate time so as to avoid excessive evaporation and losses.

After blending of the "aqueous phase" of the composition, it is added to an "aerosol" container and the container is pressurized by addition through the valve of the propellant. When several propellant components are employed, as is usual, they may be added sequentially or preferably, as a mixture. After pressurizing, the container is sealed, an appropriate valve and/or discharge spout are installed and the product may be stored, ready for use.

In use, it is a simple matter to press the aerosol can valve button and discharge the desired amount of conditioning composition. For best results, although not usually necessary, the can should be shaken before discharge so as to make sure that a uniform composition is dispensed. The foam produced may be discharged directly onto fabrics to be conditioned or may be discharged onto the hand or an appropriate container from which it may be transferred to the fabrics, as by adding it to damp laundry in a clothes dryer. Such laundry will usually contain from 20 to 70% water, the balance being dry mixed cotton and cotton-polyester, nylon and Dacron textiles. Treatment may be effected on dry materials or materials not in an automatic laundry dryer but conditioning in such cases is generally not as effective as desirable nor as convenient.

The amount of conditioning composition employed, for 8 lbs. of laundry, on a dry basis, will usually be from about 5 to 100 grams, preferably about 10 to 50 grams and most preferably about 20 grams. Such are convenient amounts to handle and package. Of course, the amount to be employed will depend on the effectiveness of the conditioning composition and often, the amount of conditioning agent will be adjusted in the formula, so that a desirable amount of product may be employed. The weights given are with respect to composition discharged from the container or conditioning article. Because some propellant may escape during the discharge operation, the weight of foam actually may be slightly less but usually is within 10% of the amount discharged. This is especially true if the foam discharged is what is characterized as a stable foam, one which will not lose its shape within a five minute period, when allowed to stand. It is desirable that the propellant be maintained in the foam because it appears that it contributes appreciably to the stability of the foam, when present in sufficient quantity and thereby, it assists in helping to deposit the conditioning agent over the surfaces of the fabrics better than would be the case if foam where unstable or soupy.

Although the stable foam will maintain its shape for a long period of time if not subjected to external forces, when it is added to a charge of damp laundry in an automatic laundry dryer, it is usually broken up and spread over the surfaces of the laundry within about 1 to 5 turns of the dryer drum. Such a drum may normally revolve at a speed from about 10 to 60 r.p.m. and the drying air employed may be at temperatures from room temperature to as high as about 100° C. Generally, the tumbling and drying operation continues for from five minutes to an hour. Under these conditions, the foam, preferably in conjunction with moisture on the fabrics being conditioned, spreads over all the surfaces of the fabrics being conditioned and acts to soften them and helps to make them antistatic. Of course, if the effect is insufficient, the formula may be varied to add more conditioning agent or a larger quantity of the composition may be used.

The advantages of the present invention have already been referred to briefly. The product is in convenient form to use and satisfactorily conditions laundry without requiring any special visit of the housewife to the laundry area. When she is taking the washed clothes, which have been rinsed and usually spun or wrung dry, and is transferring them in the damp state to the laundry dryer, she merely adds on top of the clothes the required amount of conditioning composition, as a foam, closes the dryer door and begins the drying operation. The laundry is automatically conditioned. It is convenient for the housewife to note the amount of foam being employed and she has a visual measure of how much conditioning will be obtained. Unlike cases wherein sprays are used and visual measuring is not possible, in the present cases she may rely on either such a measure or may count the time during which the discharge valve is open. The product will not become airborne nor be blown back at the user. Also, less spotting of treated laundry will be noted. This latter advantage is surprising because one might have expected that the foam would penetrate into the fibers or adhere to the fabric surface, causing an excessive concentration and resulting in objectionable spotting.

The following examples illustrate several embodiments of the invention. Unless otherwise indicated, all parts are by weight and all temperatures are in ° C.

EXAMPLE 1

| | Parts |
|---|---|
| Stearic acid, triple pressed | 5.0 |
| Triethanolamine | 2.2 |
| Soromine AT (complex fatty acids amphoteric softener, made by GAF Corp.), 20% active | 2.5 |
| Glycerine | 5.0 |
| Perfume | 0.05 |
| Water, deionized | 35.25 |
| Propellant 12 | 30.0 |
| Propellant 114 | 20.0 |

EXAMPLE 2

| | Parts |
|---|---|
| Sodium tallow alcohols sulfate (30% active, balance $Na_2SO_4$, free alcohol) | 10.0 |
| Glycerine | 5.0 |
| Brij 30 (polyoxyethylene (4) lauryl ether, made by Atlas Chemical Industries), 100% active | 2.0 |
| Cetyl alcohol | 1.0 |
| Perfume | 0.05 |
| Water, deionized | 31.95 |
| Propellant 12 | 30.0 |
| Propellant 114 | 20.0 |

EXAMPLE 3

| | Parts |
|---|---|
| Arquad R-40 (distearyl dimethyl ammonium chloride, made by Armour Industrial Chemical Co.), 40% active | 15.0 |
| Brij 30 | 2.0 |
| Cetyl alcohol | 1.0 |
| Perfume | 0.1 |
| Water, deionized | 31.9 |
| Freon 12 | 30.0 |
| Freon 114 | 20.0 |

EXAMPLE 4

| | Parts |
|---|---|
| Soromine AT | 10.0 |
| Brij 30 | 1.5 |
| Cetyl alcohol | 1.0 |
| Perfume | 0.1 |
| Water, deionized | 37.4 |
| Freon 12 | 30.0 |
| Freon 114 | 20.0 |

EXAMPLE 5

| | Parts |
|---|---|
| Stearyl dimethyl amine oxide, 38% active | 10.0 |
| Brij 30 | 2.0 |
| Cetyl alcohol | 1.0 |
| Perfume | 0.1 |
| Water, deionized | 36.9 |
| Freon 12 | 30.0 |
| Freon 114 | 20.0 |

EXAMPLE 6

| | Parts |
|---|---|
| Sodium soap of 80 tallow-20 coconut oil mix, 88% active | 10.0 |
| Propylene glycol | 5.0 |
| Perfume | 0.1 |
| Water, deionized | 34.9 |
| Freon 12 | 30.0 |
| Freon 114 | 20.0 |

EXAMPLE 7

| | Parts |
|---|---|
| Igepal CO-880 (nonylphenoxy polyethoxy ethanol, made by GAF Corp.), 100% active | 2.5 |
| Tween 61 (polyoxyethylene sorbitan | 5.0 |

-continued

| | Parts |
|---|---|
| monostearate, made by Atlas Chemical Industries), 100% active | |
| Perfume | 0.1 |
| Water | 42.4 |
| Freon 12 | 30.0 |
| Freon 114 | 20.0 |

EXAMPLE 8

| | Parts |
|---|---|
| Sodium tallow alcohols sulfate (30% active, balance $Na_2SO_4$, free alcohol) | 5.0 |
| Stearyl dimethyl amine oxide, 38% active | 2.5 |
| Water | 42.5 |
| Freon 12 | 30.0 |
| Freon 114 | 20.0 |

EXAMPLE 9

| | Parts |
|---|---|
| Sodium tallow alcohol sulfate, 30% active | 7.5 |
| Soromine AL (complex fatty amido amphoteric softener, made by GAF Corp.), 26% active | 2.5 |
| Water, deionized | 40.0 |
| Freon 12 | 30.0 |
| Freon 114 | 20.0 |

EXAMPLE 10

| | Parts |
|---|---|
| Sodium tallow alcohols sulfate, 30% active | 5.0 |
| Sodium soap (80% tallow-20% coconut oil), 88% active | 5.0 |
| Glycerine | 5.0 |
| Water, deionized | 35.0 |
| Freon 12 | 30.0 |
| Freon 114 | 20.0 |

EXAMPLE 11

| | Parts |
|---|---|
| Arquad R-40 | 10.0 |
| Soromine AT | 2.5 |
| Glycerine | 5.0 |
| Perfume | 0.1 |
| Water | 32.4 |
| Propellant 12 | 30.0 |
| Propellant 114 | 20.0 |

EXAMPLE 12

| | Parts |
|---|---|
| Stearyl dimethyl amine oxide, 38% active | 5.0 |
| Culversoft WS-30 (cationic fatty amido alkyl ammonium chloride, made by Culver Chemical Co.) 30% active | 2.5 |
| Water | 42.5 |
| Propellant 12 | 30.0 |
| Propellant 114 | 20.0 |

EXAMPLE 13

| | Parts |
|---|---|
| Stearyl dimethyl amine oxide, 38% active | 10.0 |
| Soromine AT | 2.5 |
| Perfume | 0.1 |
| Water | 37.4 |
| Freon 12 | 30.0 |
| Freon 114 | 20.0 |

EXAMPLE 14

| | Parts |
|---|---|
| Stearic acid | 5.0 |
| Triethanolamine | 2.2 |
| Polyvinylpyrrolidone | 0.5 |
| Soromine AT | 2.5 |
| Water | 39.8 |
| Freon 12 | 30.0 |
| Freon 114 | 20.0 |

The above formulations are produced by sequentially blending the ingredients, less perfume, water and propellants, at room temperature, into the water, heating and mixture or allowing its temperature to rise to 50° C., cooling it, adding the perfume and then transferring the mix to a pressure maintaining, valved container, following which the propellants are added to the container through the valve. The product is shaken to aid in forming the desirable emulsion and it is then packed and sent to storage.

In each case the product is tested by being shaken and having 20 grams thereof discharged into an 8 lb. charge of mixed damp laundry comprising approximately eight pounds anhydrous laundry and an additional six pounds of water. The laundry is approximately half cotton and half synthetic fabric. Among the synthetics charged are permanet press treated polyester-cotton blends in 65–35 parts proportion, Dacron and nylon, with the permanent press charge being the greater proportion of the synthetics. Some of the permanent press fabric is a light blue color on which oily deposits of materials are easily discerned, especially when heated and pressed. The charges of conditioning compositions, as foams, are added to the clothing in the dryer within two minute of discharge from the container and in most cases this addition is almost instantaneous. As soon as the conditioners are added, dryer operation commences with drying gas at 70° C. being admitted and the dryer revolving at about 30 r.p.m. After one or two turns of the drum the foams are mixed in with the clothing and they continue to be further distributed as the fabrics contact each other repeatedly during subsequent drying, which takes approximately 45 minutes.

All of the above compositions, applied at a rate of 20 grams to eight pounds of laundry, contribute softening and antistatic properties. However, in some cases, as with the formulas of Examples 2, 5, 6, 7, 8 and 10, increasing the amount charged to 100 grams noticeably improves these properties. With respect to foam stability, the products of Examples 3, 5, 11, 12 and 13 are not as stable as desirable. The other formulations are all stable enough to last for five minutes, without change of shape and actually can be passed back and forth between the hands without being destroyed.

Although the above formulas, articles, foams and processes described are useful for conditioning fabrics and, surprisingly, do not cause oily staining of them to an objectionable extent that might been expected from the nature of the process, other modifications of these formulas would also make useful products. For example, the propellants employed may be changed, substituting high and low pressure propellants other than those listed, e.g., Freons 11, 21, 22, 113, octafluorocyclobutane, isobutane, without adversely affecting the properties of the product. Other cationic materials of the types previously described and other amphoterics may well be employed in place of the Arquad R-40, Culversoft WS-30, Soromine AL, and Soromine AT. Thus Miramines, e.g., Miramine SH, Miranols, e.g., Miranol C2M, both made by Miranol Chemical Co. Inc., and Deriphats, e.g., Deriphat 160C, made by General Mills, Inc., may be used instead of corresponding cationics and amphoterics or in supplement of them. Different nonionics may be employed. For example, Pluronics may be used in place of the nonionics of the examples. Different anionics may replace the soaps, e.g., magnesium, aluminum soaps. Proportions may be varied and resins, thickeners, diluents and foam stabilizers may be added or subtracted from the formulas with good products still resulting. Preferably, such substitutions and changes will be with products described previously in the specification. Modifications of proportions will be apparent to one of skill in the art to either increase or decrease softening and antistatic effects and in similar manner, if any objectionable spotting should be observed, it may be obviated by changing the concentrations of the conditioning agents used or by adding release agents, as have been described in other patent applications filed by co-workers in our assignee's laboratories.

The invention has been described with respect to various descriptions and illustrative examples thereof. It is not to be so limited since it is apparent to one of skill in the art that substitutions may be made and equivalents may be utilized without departing from the spirit of the invention.

What is claimed is:

1. A method of conditioning fabrics which comprises applying to a fabric a pressurized composition consisting essentially of (1) from about 0.5 to 15% by weight of a surface active conditioning agent selected from the group consisting of higher fatty acid soaps, cationic, amphoteric, nonionic and anionic compounds, (2) from about 0.5 to 15% by weight of a foaming agent selected from the group consisting of anionic and nonionic detergents, (3) from 10 to 79% by weight of normally gaseous propellant selected from the group consisting of aliphatic and cycloaliphatic hydrocarbons, chlorofluorocarbons and fluorocarbons, and the balance water, said composition forming a firm, self-sustaining lather, sufficiently firm to be self sustaining for a period of about 5 minutes spreading of the lather over the surfaces of the fabric being effected by tumbling said fabric in a laundry dryer.

2. A method of conditioning damp fabrics which comprises tumble-drying said fabrics in the presence of a conditioning agent in the form of a foam said foam being characterized as being sufficiently firm to be self-sustaining for a period of about 5 minutes when applied to a stationary surface.

3. A method of treating clothing articles with an adjuvant material which comprises contacting at least a portion of said clothing articles with an easily distributable foam containing said adjuvant material, said foam being surface adherent for at least about thirty seconds, and subjecting said foam-contacted clothing to a tumbling, dry-heat, anhydrous environment.

4. The method of claim 3, wherein said environment is a clothes dryer.

5. The method of claim 3, wherein said foam is stable, substantially form-sustaining, substantially nonpenetrating, surface adherent and easily distributable.

6. A method of treating clothing articles in a clothes dryer with an adjuvant material which comprises the steps of (A) contacting at least a portion of said clothing articles with a stable, substantially form-sustaining, substantially nonpenetrating, surface adherent, and easily distributable foam, said foam comprising, by weight of the total composition, (a) from about 1.0 to 30.0 percent of said adjuvant material, (b) from about 50.0 to 94.0 percent of a solubilizer, (c) from about 5.0 to 25.0 percent of a propellant, and (d) from 0 to 30.0 percent of a foaming agent, and (B) subjecting said clothing articles to a tumbling action in a dry heat, substantially anhydrous environment.

7. The method of claim 6, wherein the solubilizer comprises a member selected from the group consisting of water, isopropyl alcohol and dichloromethane and mixtures thereof.

8. The method of claim 6, wherein the propellant is a member selected from the group consisting of dichlorodifluoromethane and dichlorotetrafluoroethane and mixtures thereof.

9. A method of treating clothing articles with an adjuvant material which comprises contacting at least a portion of said clothing articles with an easily distributable foam containing said adjuvant material, said foam being surface adherent for at least about five minutes, and subjecting said foam-contacted clothing to a tumbling, dry-heat, anhydrous environment.

10. The method of claim 9, wherein said environment is a clothes dryer.

11. The method of claim 9, wherein said foam is stable, substantially form-sustaining, substantially nonpenetrating, surface adherent and easily distributable.

12. A method of treating clothing articles in a clothes dryer with an adjuvant material which comprises the steps of (A) contacting at least a portion of said clothing articles with a stable, substantially form-sustaining, substantially nonpenetrating, surface adherent, and easily distributable foam, said foam comprising, by weight of the total composition, (a) from about 1.0 to 15 percent of said adjuvant material, (b) about 50.0 percent of a solubilizer, (c) from about 10 to 25.0 percent of a propellant, and (d) from 0.5 to 15 percent of a foaming agent, and (B) subjecting said clothing articles to a tumbling action in a dry heat, substantially anhydrous environment.

13. The method of claim 12, wherein the solubilizer comprises a member selected from the group consisting of water and dichloromethane and mixtures thereof.

14. The method of claim 12, wherein the solubilizer comprises water.

15. The method of claim 12, wherein the propellant is a member selected from the group consisting of dichlorodifluoromethane and dichlorotetrafluoroethane and mixtures thereof.

16. A method of treating clothing articles in a clothes dryer with a fabric softener which comprises the steps of (A) contacting at least a portion of said clothing articles with a stable, substantially form-sustaining, substantially non-penetrating, surface adherent, and easily distributable foam, said foam comprising, by weight of the total composition, (a) from about 1.0 to 30.0 percent of said fabric softener, (b) from about 50.0 to 94.0 percent of a solubilizer, and (c) from about 5.0 to 25.0 percent of a propellant, and wherein the solubilizer includes water in an amount comprising at least 40.0 percent of the total composition, and (B) subjecting said clothing articles to a tumbling action in a dry heat, substantially anhydrous environment.

17. The method of claim 16, wherein the propellant is a member selected from the group consisting of dichlorodifluoromethane and dichlorotetrafluoroethane and mixtures thereof.

18. A method of treating clothing articles in a clothes dryer with a fabric softener which comprises the steps of (A) contacting at least a portion of said clothing articles with a stable, substantially form-sustaining, substantially non-penetrating, surface adherent, and easily distributable foam, said foam comprising, by weight of the total composition, (a) from about 1.0 to 15.0 of said fabric softener, (b) about 50.0 percent of a solubilizer, and (c) about 10.0 to 25.0 percent of a propellant, and wherein the solubilizer includes water in an amount comprising at least 40.0 percent of the total composition, and (B) subjecting said clothing articles to a tumbling action in a dry heat, substantially anhydrous environment.

19. The method of claim 18, wherein the propellant is a member selected from the group consisting of dichlorodifluoromethane and dichlorotetrafluoroethane and mixtures thereof.

20. A method of conditioning fabrics in a clothes dryer which comprises applying to a fabric a composition comprising a foaming agent, a fabric conditioner, a normally gaseous propellant and water, as a foam, and spreading the foam over the surfaces of the fabric by subjecting the fabric to a tumbling action in said dryer.

21. A method according to claim 20 wherein the composition, shortly before discharge as a foam and before application to the fabric comprises from 0.5 to 15% of a foaming agent which is a lower alkanolamine soap of higher fatty acids, a water insoluble metal soap of such acids, a polyoxy-lower alkylene higher alkyl ether or a higher alkyl di-lower alkyl amine oxide, 0.5 to 15% complex fatty amido amphoteric or quaternary ammonium surface active fabric conditioner, 20 to 50% of water and 10 to 79% of a mixture of a major proportion of high pressure chloro-fluorocarbon and a minor proportion of low pressure chloro-fluorocarbon propellant.

22. A method of treating clothing articles in a clothes dryer with an adjuvant material which comprises the steps of (A) contacting at least a portion of said clothing articles with a stable, substantially form-sustaining, substantially non-penetrating, surface adherent, and easily distributable foam, said foam comprising, by weight of the total composition, (a) from about 1.0 to 15 percent of said adjuvant material, (b) at least about 50.0 percent of a solubilizer, (c) from about 10 to 25.0 percent of a propellant, and (d) from 0.5 to 15 percent of a foaming agent, and (B) subjecting said clothing articles to a tumbling action in a dry heat, substantially anhydrous environment.

23. The method of claim 22, wherein the foam comprises by weight of the total composition (a) from about 5.0 to 25.0 percent adjuvant, (b) from about 65 to 85 percent solubilizer, and (c) the balance propellant.

24. The method of claim 22, wherein the foam comprises by weight of the total composition (a) from about 0.5 to 15 percent adjuvant, (b) up to about 80 percent solubilizer, and (c) the balance propellant.

25. A method of treating clothing articles in a clothes dryer with a fabric softener which comprises the steps of (A) contacting at least a portion of said clothing articles with a stable, substantially form-sustaining, substantially non-penetrating, surface adherent, and easily distributable foam, said foam comprising, by weight of the total composition, (a) from about 1.0 to 15.0 of said fabric softener, (b) at least about 50.0 percent of a solubilizer, and (c) about 10.0 to 25.0 percent of a propellant, and wherein the solubilizer includes water in an amount comprising at least 40.0 percent of the total composition, and (B) subjecting said clothing articles to a tumbling action in a dry heat, substantially anhydrous environment.

26. The method of claim 25, wherein the foam comprises by weight of the total composition (a) from about 3.0 to 15.0 percent fabric softener, (b) from about 65.0 to 90.0 percent solubilizer, and (c) the balance propellant.

27. The method of claim 25, wherein the foam comprises by weight of the total composition (a) from about 0.5 to 15 percent fabric softener, (b) up to about 80 percent solubilizer, and (c) the balance propellant.

28. A method of treating clothing articles in a clothes dryer with a fabric softener which comprises the steps of (A) contacting at least a portion of said clothing articles with a stable, substantially form-sustaining, substantially non-penetrating, surface adherent, and easily distributable foam, said foam comprising as principal ingredients, by weight of the total composition, (a) from about 1.0 to 15.0 percent of said fabric softener, (b) at least about 50.0 percent of a solubilizer, and (c) about 10.0 to 25.0 percent of a propellant, and wherein the solubilizer includes water in an amount comprising at least 40.0 percent of the total composition, and (B) subjecting said clothing articles to a tumbling action in a dry heat, substantially anhydrous environment.

* * * * *